US010611007B2

(12) United States Patent
Seamons

(10) Patent No.: US 10,611,007 B2
(45) Date of Patent: Apr. 7, 2020

(54) MOEN® TYPE VALVE CARTRIDGE EXTRACTOR TOOL HAVING BOTH RIGHT-HAND AND LEFT-HAND THREADS

(71) Applicant: Brandon Lee Seamons, Mapleton, UT (US)

(72) Inventor: Brandon Lee Seamons, Mapleton, UT (US)

( * ) Notice: Subject to any disclaimer, the term of this patent is extended or adjusted under 35 U.S.C. 154(b) by 158 days.

(21) Appl. No.: 15/491,984

(22) Filed: Apr. 20, 2017

(65) Prior Publication Data

US 2018/0304451 A1 Oct. 25, 2018

(51) Int. Cl.
*B25B 27/24* (2006.01)

(52) U.S. Cl.
CPC ..... *B25B 27/24* (2013.01)

(58) Field of Classification Search
CPC ..... B25B 27/24; B25B 27/143; B25B 27/18; B25B 21/002; B25B 28/00; B25B 21/004
USPC ..... 29/255, 287, 280, 221.6; 269/242
See application file for complete search history.

(56) References Cited

U.S. PATENT DOCUMENTS 3,183,732 A * 5/1965 Porath ..... F16H 25/24 74/89.43
4,376,332 A * 3/1983 Sandefur ..... B25B 27/18 29/402.08
2008/0235930 A1* 10/2008 English ..... B25B 27/062 29/426.5

OTHER PUBLICATIONS www.homedepot.com JAG Plumbing Products Cartridge Removal Tool for MOEN Cartridges Model #18-148Internet #205818724 (Year: 2016).*
www.ebay.com eBay item No. 381141104078 Cartridge Puller Tool for Moen Posi-Temp 1222 1222B 1225 1225B 1200B (Year: 2016).*
https://www.amazon.com/Moen-1225-One-Handle-Cartridge-Replacennent/dp/B0006290R6 Moen 1255 One-Handle Bathroom Faucet Cartridge Replacement, Brass (Year: 2008).*
https://www.amazon.com/Cartridge-Puller-Single-Handle-Cartridges/dp/B008PFQOAC Moen Cartridge Puller for ALL 1200, 1222, & 1225 Single Handle Cartridges (Year: 2013).*
https://www.homedepot.com/p/MOEN-Single-Handle-Replacement-Cartridge-1200/100445056 Moen Single-Handle Replacement Cartridge (Year: 2011).*
www.homedept.com JAG Plumbing Products Cartridge Removal Tool for MOEN Cartridges Model #18-148Internet #205818724 (Year: 2016).*
https://www.homedepot.com MOEN, Single-Handle Replacement Cartridges (Year: 2011).*

(Continued)

*Primary Examiner* — Tyrone V Hall, Jr.
*Assistant Examiner* — Abbie E Quann
(74) *Attorney, Agent, or Firm* — Angus C. Fox, III

(57) ABSTRACT

A two piece tool with an adapter sleeve is provided that extracts both ¾-inch and 1-inch diameter Moen®-type valve cartridges from the valve body. An extractor shaft incorporates a right-hand male 10-24 threaded shank at the fore end thereof, in addition to a much longer and larger diameter left-hand Acme male thread. The Acme male thread thread engages a left-hand female Acme thread at the aft end of a tubular extractor body. The aft end of the extractor shaft is equipped with a quarter-inch hexagonal drive that couples to a portable electric drill motor. Clockwise rotation of the extractor shaft while holding and preventing the tubular extractor body from rotating allows the threaded shank to engage the cartridge control shaft, while simultaneously pushing the extractor body toward the valve body. Once the extractor body abuts the valve body, the cartridge is extracted, all in a single step.

17 Claims, 7 Drawing Sheets

(56) References Cited

OTHER PUBLICATIONS

Wholesale Plumbing Supply, ,https://www.amazon.com/Cartridge-Puller-Single-Handle-Cartridge-Replacement/dp/B008PFQOAC, Jul. 26, 2012 (Screen shot of WholeSale Plumbing Supply for 10-24 thread) (Year: 2012).* https://www.homedepot.com/p/MOEN-Posi-Temp-Pressure-Balanced-Shower-Cartridge-1222/202059049 Posi-Temp Pressure Balanced Shower Cartridge , Apr. 9, 2011 (Year: 2011).*

Wholesale Plumbing Supply, https://www.amazon.com/cartridge-puller-single-handle-cartridge-replacennent/dp/B008PFQOAC, Jul. 26, 2012 (Year: 2012).* www.homedepot.com JAG Plumbing ProductsCartridge Removal Tool for MOEAN Cartridges Model #18-148 Internet #205818724 (Year: 2016).* https://www.homedepot.com MOEAN, Single-Handle Replacement Cartridges (Year: 2011).*

Wholesale Plumbing Supply, https://www.amazon.com/cartridge-puller-single-handle-cartridge-replacennent/dp/B008PFQOAC, Jul. 26, 2012 (Screenshot of Whole Sale Plumbing Supply for 10-24 thread) (Year: 2012).* https://www.homedepot.com/p/MOEAN-Posi-Temp-Pressure-Balanced-Shower-Cartridge-1222/202059049 Posi-Temp Pressure Balanced Shower Cartridge Apr. 9, 2011 (Year: 2011).* https://www.amazon.com/Impact-Socket-Adapter-Driver-Extension/dp/B071WQDDSV/ref=asc_df_B071WQDDSV/?tag=hyprod-20&linkCode=df0&hvadid=309735728871&hvpos=1o1&hvnetw=g&hvrand =3585369826346422435&hvpone=&hvptwo=&hvqmt=&hvdev=c&hvdvcmdl=&hvlocint=&hvlocphy=9008192&hvtargid=pla-568252702214&psc=13PCS (Year: 2017).*

Wholesale Plumbing Supply, https://www.amazon.com/cartridge-puller-single-handle-cartridge-replacement/dp/B008PFQOAC, Jul. 26, 2012 (Year: 2012).* https://jet.com Kissler 13705 Moen Cartridge Puller Brand: Kissler & Co Part No. 08-0423.

www.ebay.com eBay item No. 381141104078 Cartridge Pulloer Tool for Moen Posi-Temp 1222 1222B 1225 1225B 1200 1200B.

www.homedepot.com JAG Plumbing Products partridge Removal Tool for MOEN Cartridges Model #18-148 Internet #205818724.

* cited by examiner

MOEN® TYPE VALVE CARTRIDGE EXTRACTOR TOOL HAVING BOTH RIGHT-HAND AND LEFT-HAND THREADS

FIELD OF THE INVENTION

The present invention relates, generally, to maintenance tools for cartridge-type faucets and, more particularly, to tools designed to extract Moen®-type cartridges from Moen®-type valve bodies.

BACKGROUND OF THE INVENTION

Alfred M. Moen was the inventor of the Moen® single-handle "Dialcet" mixing faucet and the founder of Moen, Inc., a manufacturer of single-handle faucets and other plumbing products. Born in Seattle, Wash. on Dec. 27, 1916, Moen graduated from Franklin High School in 1934 and later studied mechanical engineering at the University of Washington. In 1959, *Fortune Magazine* listed the Moen® "one-handle mixing faucet," along with inventions such as Henry Ford's Model T and Benjamin Franklin's Franklin stove, as one of the top 100 best-designed mass-produced products. This distinction was the result of a survey among the world's leading industrial designers, architects and university professors of industrial design conducted by industrial designer Jay Doblin. Al Moen was nominated to the National Inventors Hall of Fame and was named to the Kitchen & Bath Industry Hall of Fame in 1993.

The inspiration for Al Moen's invention came in 1937 after he turned on a two-handle faucet and burned his hands. Over the next decade, Moen made several faucet designs and improvements. With the advent of World War II, he went to work as a tool designer at a military shipyard plant in Seattle. Moen could not find a manufacturer free to start production until after the war. In 1947, he persuaded Kemp Hiatt at Ravenna Metal Products of Seattle to finance and produce his latest design for a single-handled mixing faucet. This led to the creation of Moen, Inc., one of the nation's major producers of plumbing products. Moen® faucets were soon included in many homes built in the United States during the post-World War II building boom. In 1956, Stanadyne, a major manufacturer of diesel injection pumps, negotiated with Ravenna Metal Projects to acquire rights to the Moen® single-handle faucet. By 1979, Moen® faucet revenues had reaced $100 million, one quarter of Stanadyne's total revenue. Al Moen served as head of the company's research and development until his retirement in 1982. Stanadyne was acquired by Forstmann-Little & Company in 1988 and then purchased by the consumer-products holding company Fortune Brands. Fortune Brands then spun off its related product lines to form the Fortune Brands Home & Security company on Oct. 3, 2011.

Most Moen® kitchen, washbasin, and bathtub/shower faucets are of the single-handle design, and almost all have used the same basic water-controlling cartridge since the 1960s. Known as the Moen® 1225, it is a plastic (older versions were brass) cylinder approximately 4 inches long by ¾ inches in diameter. As the core component in most Moen® single-handle faucets, it has undergone at least two revisions since its inception though newer versions remain compatible with older faucets. Pulling up the control stem of the cartridge opens the water supply; rotating the control stem toward the left (i.e., counterclockwise) opens the hot water passages while rotating it to the right (i.e., clockwise) opens the cold water passages (using the standard North American convention of the hot water control on the left).

Later Moen® bathtub/shower controls with single handles use a larger cartridge with a pressure balancing mechanism which compensates for sudden pressure changes in either the hot or cold water supply inputs to the valve (as caused by a toilet being flushed while someone is showering). The design goal is to maintain the temperature of the shower for safety and comfort reasons, even if the volume of water is reduced. The cartridge is known as the 1222. The operation is similar to the 1225 (above) though the cartridge is approximately 1 inch in diameter to allow space for the pressure balancing mechanism.

Referring now to FIG. 1, the standard Moen® faucet valve 100 with a 0.75-inch diameter cylindrical valve cartridge containment chamber 101, and the pressure-balancing feature, has been around since the 1960s. The valve cartridge is 102 is about 0.75 inch in diameter, and is held in place by a retainer clip 103. The lip 104 surrounding the valve cartridge containment chamber 101 is approximately 0.125 inch wide, resulting in a cartridge housing 105 that is about one inch in outside diameter. A rotatable brass control stem 106 is free to rotate axially as long as no trim components are installed on the valve. An aperture 107 axially drilled in the exposed end of the rotatable brass control stem 106 and threaded with a 10-24 tap enables a handle to be secured to the axially-slidable and rotatable control stem 106 and also allows the cartridge to be extracted using several available valve cartridge extractors following removal of the retainer clip 103 that prevents axial movement of the cartridge within the cartridge containment chamber 101. Millions of these faucet valves were installed in residential showers, bathtubs and faucets until the federal government, in its superior wisdom, decided that such valves posed a risk of scalding users.

Referring now to FIG. 2, a Model 2520 Moen® Posi-Temp faucet valve 200 has a one-inch diameter cylindrical valve cartridge containment chamber 201. The lip 202 surrounding the chamber is approximately 0.125 inch wide, resulting in a cartridge housing 203 that is about 1.25 inch in diameter. Ears 204-U and 204-L on the Moen® Posi-Temp Model 1220 cartridge 205 fit within upper and lower recesses 206-U and 206-L, respectively, in the lip 202. As with the older style Moen® valve, the exposed end of a rotatable brass control stem 207 is equipped with an aperture 208 that is axially drilled and threaded with a 10-24 tap so that a handle can be secured to the control stem 207 and so that the cartridge 205 can be extracted using several available valve cartridge extractors. A retainer clip 209 prevents axial and rotational movement of the cartridge 205 within the cartridge containment chamber 201, thereby securing the cartridge 205 within the valve cartridge containment chamber 201.

Referring now to FIG. 3, the Moen® Posi-Temp faucet valve body 300 is identical to that of FIG. 2, with the exception that this valve body 300 has lip extensions 301-A and 301-B at the opening of the valve cartridge containment chamber. The presence of lip extensions 301-A and 301-B necessitate the cutouts 606-A and 606-B on the fore end of the tubular extractor body 600. As a matter of clarification, the cartridge housing is that generally cylindrical portion of the valve body that actually holds the cartridge. Thus, if the cartridge has been extracted from the cartridge housing, it has also been extracted from the valve body.

Moen® cartridges are so reliable that many remain in place for more than 30 years without servicing. A problem associated with the longevity of Moen® valve cartridges is that hard water deposits build up within the valve body over time and interfere with extraction of the cartridge from the cylindrical bore of the valve body. A cylindrical bore coated with hard water deposits is of smaller diameter than the rubber seals on the cartridge that must be removed. Invariably, the removal of an old cartridge from the valve body results in complete destruction of the cartridge seals. Consequently, without the proper extraction tools, replacement of a Moen® valve cartridge can be extremely difficult.

A number of different tools have been designed to facilitate the extraction of a Moen® valve cartridge from the valve body. Some are more effective than others.

Danco, a company having its headquarters at 2727 Chemsearch Blvd. in Irving, Tex. 75062, manufactures a four-piece 86712A Cartridge Puller for Moen® cartridges. An externally-threaded aluminum puller shaft, having an aluminum handle, is axially drilled so that it can be secured to the threaded aperture of the cartridge control stem using a separate 10-24 steel screw. An internally-threaded aluminum collar threadably engages the external threads of the puller shaft. While hold the aluminum handle, the collar is tightened against the lip of the cartridge housing, using a large wrench, to remove the cartridge. For tough jobs, it can be considered a one-time use tool, as the aluminum tends to bend and break.

JAG Plumbing Products, a company having its headquarters at 901 Dillingham Road, Pickering, Ontario, Canada L1W 2Y5 supplies a more robust, four-piece Moen® cartridge extractor tool that functions much like the Danco tool. Manufactured of steel and composite materials, it uses a steel right-hand-threaded central puller shaft having a 10-24 coupler screw that engages the threaded aperture of the brass cartridge control stem. A fiber-reinforced plastic composite extractor collar fits over the puller shaft and is threadably and rotatably coupled to the puller shaft by means of a laminar steel handle that is drilled and tapped in the center to engage the threads of the puller shaft. This extractor collar is designed for the removal of ¾-inch diameter cartridges. Thus, removal of the cartridge is a three-step process: first, thread the coupler screw into the threaded aperture of the cartridge control stem; second, prevent the puller shaft from rotating with an adjustable-end wrench; and three, tighten the extractor collar against the lip of the cartridge housing, thereby extracting the cartridge. For 1-inch diameter cartridges, a fiber reinforced plastic composite adapter fits over the fore end of the extractor collar.

SUMMARY OF THE INVENTION

The present invention provides a new tool that can extract 1-inch diameter Moen®-type Posi-Temp valve cartridges, such as the 1222 valve cartridge, as well as ¾-inch diameter Moen®-type cartridges, such as the 1225 valve cartridges from the valve body in a single step. The term Moen®-type cartridges is used because the patents have long expired on the basic valve designs. Companies other than Moen® manufacture compatible valves and cartridges. The tool fundamentally comprises two pieces. The first piece is an extractor shaft having a right-hand threaded coupler shank protruding from the fore end of the extractor shaft that screws into the 10-24 threaded handle securing aperture in the exposed end of the rotatable control stem of a Moen® single-handle faucet cartridge, a much larger diameter left-hand male Acme thread along a major portion of the shaft, and a hexagonal drive shaft axially protruding from the aft end of the extractor shaft that couples to a portable electric drill motor. The second piece is a tubular extractor body having left-hand Acme female thread at the aft end thereof that threadably engages the left-hand male Acme thread of the extractor shaft. The fore end of the tubular extractor body abuts against the lips at the opening of the cylindrical cartridge socket of the valve body. The tubular extractor body is also equipped with a pair of opposed longitudinal slots, which provide clearance for the plastic tabs of the Posi-Temp® cartridge as it is extracted. Although the threaded 10-24 shank of the extractor shaft is removable so that it can be replaced if the tool is dropped and the shank breaks, the shank could be machined as part of the extractor shaft. In any case, once the shank is installed in a threaded aperture in the fore end of the extractor shaft, the shaft and the threaded shank function as a single integrated component. Although a two-piece tool can be made for each size of Moen® cartridge, the sake of enhanced functionality and reduced procurement cost, a two piece tool is provided that fits the larger one-inch-diameter Moen® cartridge, and an adapter sleeve (a third piece), is provided that enables the tool to also be used to extract ¾-inch-diameter cartridges from the earlier style Moen® valves which do not incorporate the pressure-balancing feature.

The cartridge extractor tool of the present invention is unique in that it incorporates both a right-hand male thread and a left-hand male thread on the same shaft. Because the extractor shaft is equipped with both a left-hand thread and a right-hand thread, any Moen® cartridge can be extracted from the valve body in a single step following removal of the retainer clip. With the exposed tip of the threaded shank about even with the fore end of the tubular extractor body, the threaded coupler shank is driven into the female threaded aperture of the cartridge control stem, using the hand-held electric drill motor for rotational movement of the extractor shaft. At the same time as the threaded shank is being driven into the female threaded aperture of the cartridge control stem, the tubular extractor body is being driven forward toward the valve body by the action of the left-hand Acme thread. As soon as the fore end of the tubular extractor body contacts the lips of the cartridge socket, extraction of the cartridge from the valve body begins. Because the cartridge control stem is free to rotate within the cartridge, it spins freely, driven by the extractor shaft, as the cartridge is extracted from the valve body.

As previously stated, in order to extend longevity of the tool, the coupler shank is not unitary with the extractor shaft. The fore end of the extractor shaft is drilled and tapped to receive the 10-24 threaded shank. For a preferred embodiment of the invention, a 10-24 nut is secured to the 10-24 threaded shank with a cyano-acrylate thread locking compound, and the shank is screwed into the drilled and tapped aperture at the fore end of the extractor shaft until the 10-24 nut is tight against the fore end of the extractor shaft. Thus, if the tool is inadvertently dropped and falls on the coupler shank, the coupler shank will fracture in front of the 10-24 nut, thereby enabling the remaining threaded coupler shank to be removed from the extractor shaft by engaging the nut with a wrench and rotating the shank counterclockwise. A new, unbroken threaded shank with nut secured thereon can be installed in the fore end of the extractor shaft, thereby restoring complete functionality to the extractor shaft.

Some, but not all models of the Moen® Posi-Temp valves have lip extensions at the opening of the valve cartridge containment chamber of the valve body. Why this feature exists is a mystery. Nevertheless, because of the presence of lip extensions on some of the valve bodies, the fore end of the tubular extractor body has shallow cutouts which fit over the lip extensions on the valve cartridge containment chamber opening. For Posi-Temp valve bodies without the lip extensions, the cutouts serve no purpose.

PREFERRED EMBODIMENT OF THE INVENTION

The invention will now be described with reference to the attached drawing figures. It should be understood that the drawings may not be drawn to exact scale and are intended to be merely illustrative of the invention.

Figure 4:
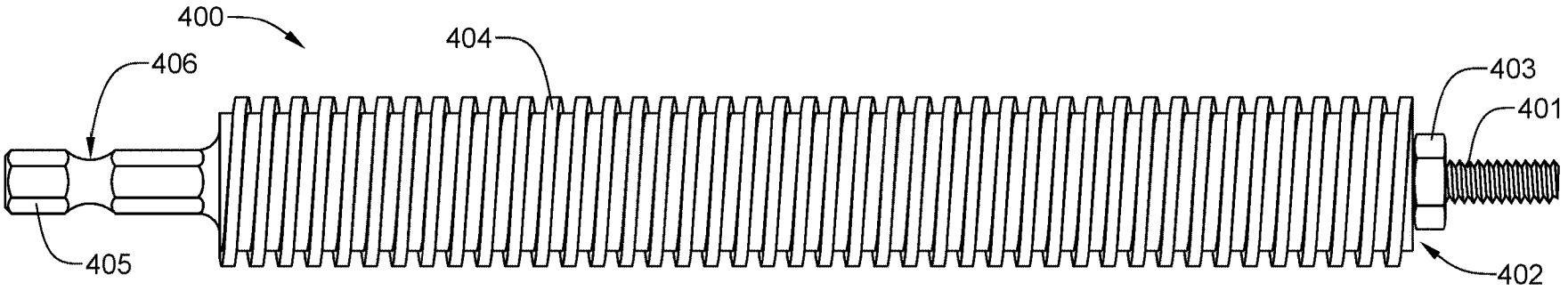
FIG. 4 is a side elevational view of the extractor shaft with the 10-24 threaded shank installed in the fore end thereof.
Figure 5:
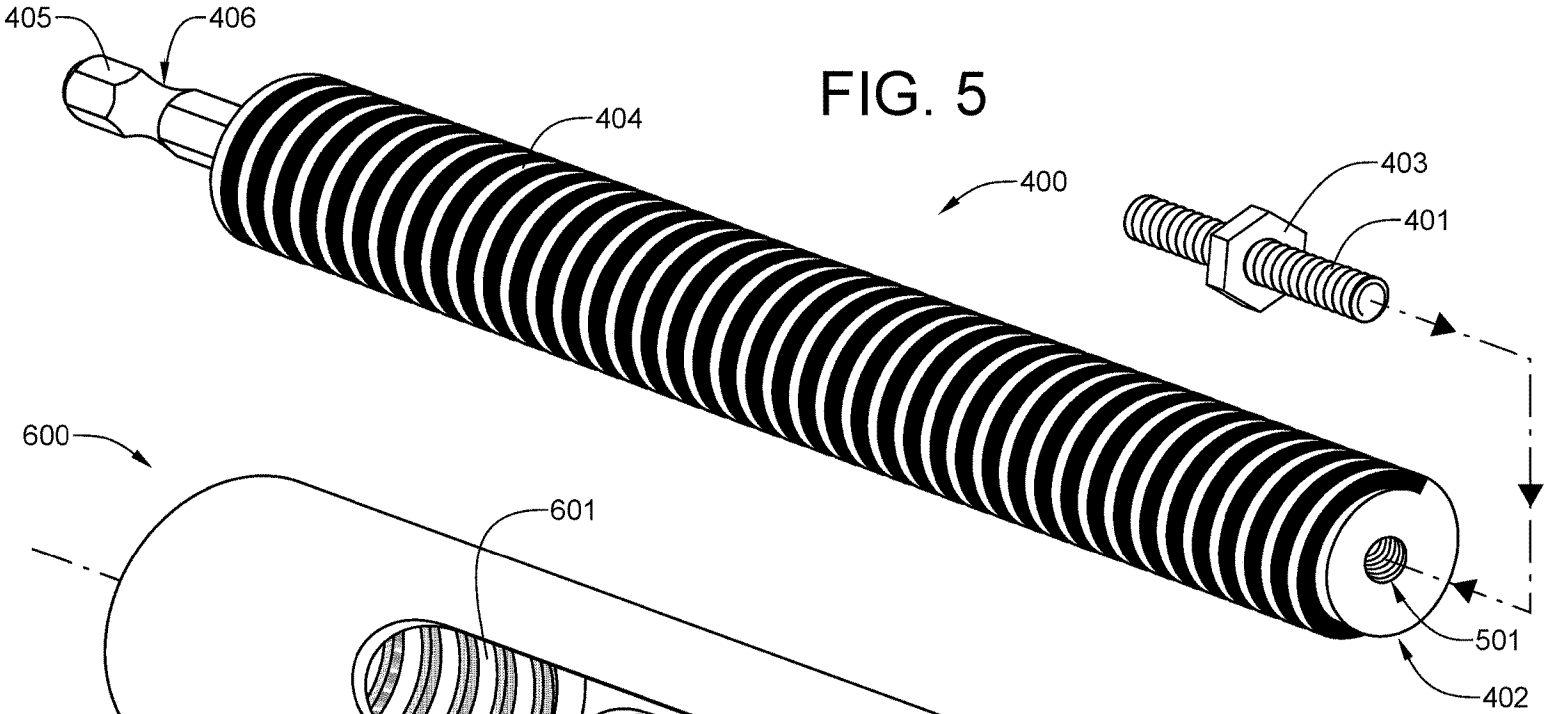
FIG. 5 is an isometric view of the extractor shaft showing the 10-24 threaded shank and optional 10-24 nut removed from the drilled and tapped aperture in the fore end of the extractor shaft.

Referring now to FIGS. 4 and 5, an extractor shaft 400 incorporates both right-hand and left-hand threaded elements. A size 10 right-hand-threaded coupler shank 401 having 24 threads per inch is installed in an axially-drilled and tapped aperture 501 at the fore end 402 of the extractor shaft 400. It will be noted that an optional 10-24 nut 403 has been threadably installed on the threaded shank 401. Thus, if the tool is inadvertently dropped and the threaded shank 401 receives a blow, it will fracture in front of the 10-24 nut 403, thereby enabling the remainder of the threaded shank 401 to be removed from the extractor shaft by engaging the nut 403 with a wrench and rotating the shank counterclockwise until it is unscrewed from the aperture 501. A new, unbroken threaded coupler shank with a nut secured thereon can be installed in the fore end of the extractor shaft. The threaded coupler shank 401 at the fore end 402 of the extractor shaft 400 engages the internally-threaded aperture 107 or 208 on the axially-rotatable control stem 106 or 207, respectively of a Moen® cartridge 100 or 200, respectively. A major portion of the extractor shaft 100, which has a nominal diameter of 0.75 inch, incorporates a much larger, left-hand Acme male thread 404 along a major portion of the extractor shaft 400. Both the left-hand Acme male thread 404 and the right-hand male thread on the threaded shank are coaxial. The aft end of the extractor shaft 400 is equipped with a quarter-inch hexagonal drive shaft 405 having an annular retaining groove 406 that engages a snap-on quarter-inch hexagonal socket installed on a hand-held electric drill motor (not shown). The presently preferred dimensions of the extractor shaft 400 are as follows: 0.190 inch outside diameter of the threaded shank 401; exposed length of the threaded shank, 0.5 inch; 0.745 inch outside diameter of the male Acme thread; the male Acme thread is 5.275 inches in length; the hexagonal drive shaft is a nominal 0.25 inch between parallel flats; and length of the hexagonal drive shaft is 0.95 inch.

Here is a brief history and explanation of the benefits of Acme threads. An Acme thread is a screw thread profile with a trapezoidal outline. Such threads are the most common forms used for both power screws and lathe leadscrews. They offer high strength and ease of manufacture. They are typically found where large loads are required, as in a vise or the leadscrew of a lathe. Standardized variations include multiple-start threads, left-hand threads, and self-centering threads. The Acme thread, which is the original trapezoidal thread form, is still probably the one most commonly encountered worldwide. The Acme thread was developed in 1894 as a profile well suited to power screws that has various advantages over the square thread, which had been the form of choice until that time. It is easier to cut via either single-point threading or die than the square thread because the latter's shape requires a tool bit or die tooth geometry that is poorly suited to cutting; it wears better than square because compensation can be made for wear; it is stronger than a comparably sized square thread; and it makes for smoother engagement of the half nuts on a lathe leadscrew than does square threading.

Figure 1:
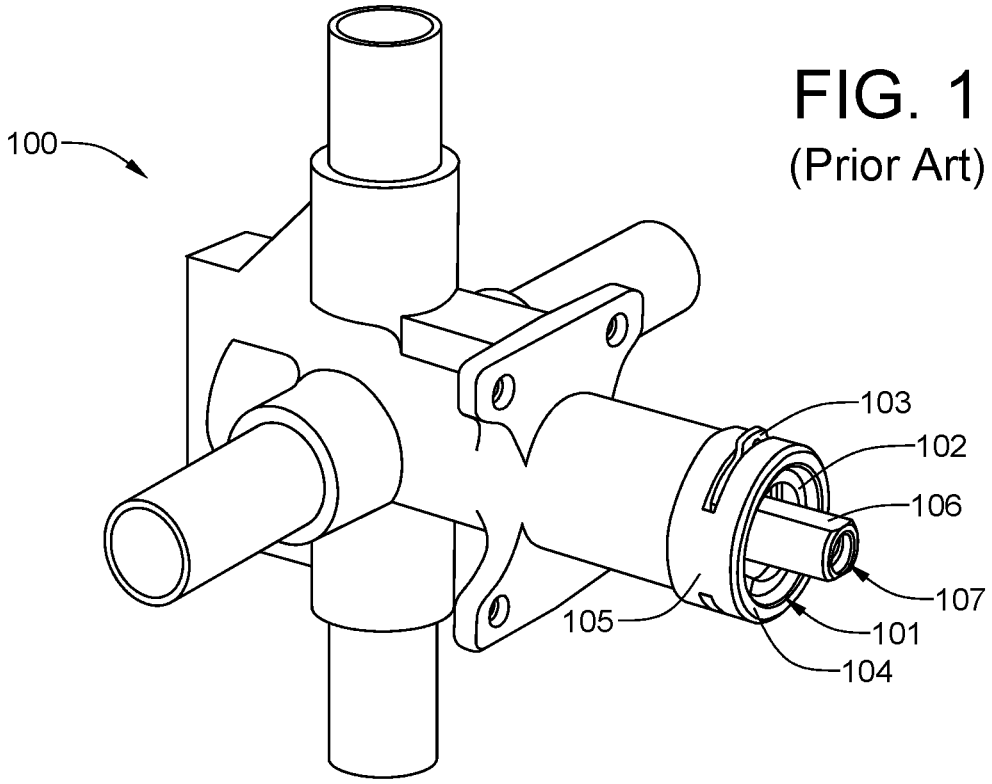
FIG. 1 (Prior Art)
FIG. 1 is a older style Moen® single-handle mixing valve that uses the ¾-inch-diameter Moen® I 1225 cartridge.
Figure 2:
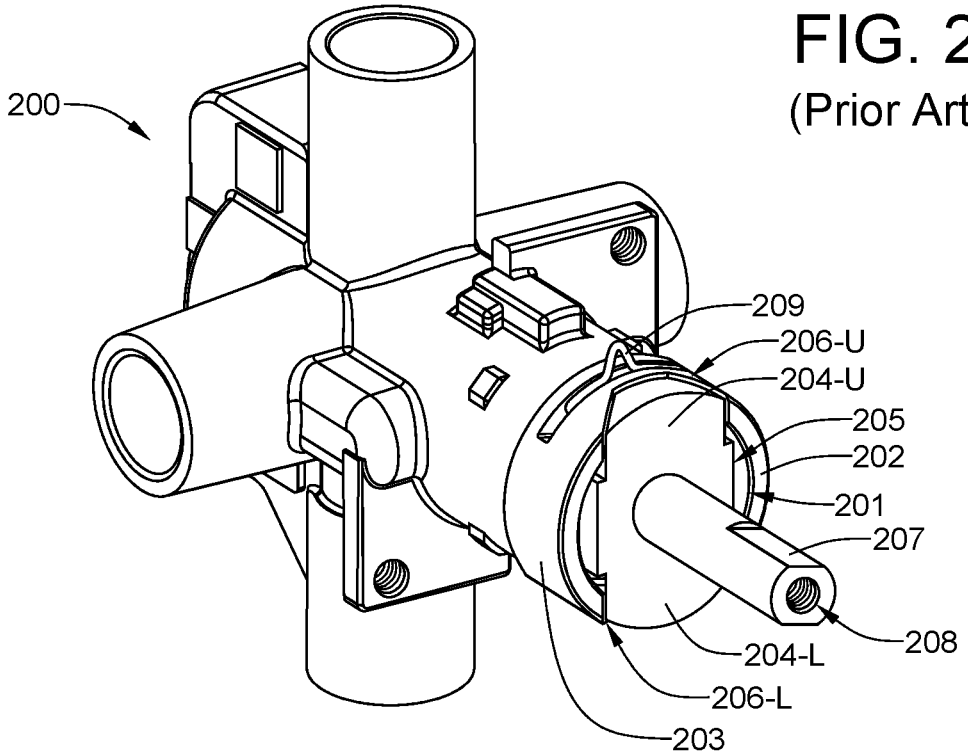
FIG. 2 (Prior Art)
FIG. 2 is a Model 2520 Moen® Posi-Temp valve body without lip extensions, with the Model 1222 cartridge installed therein.
Figure 3:
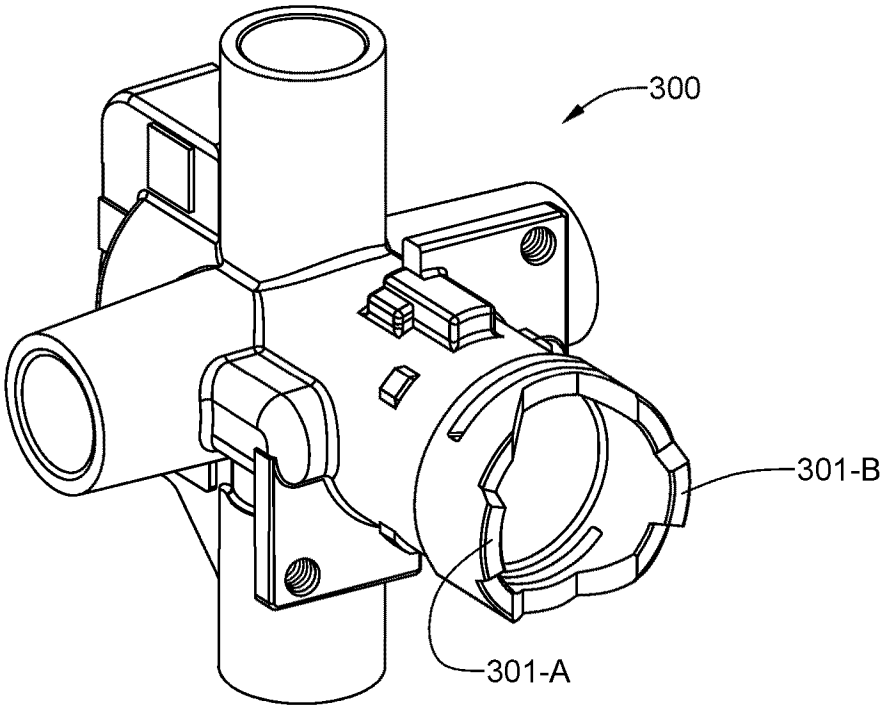
FIG. 3 (Prior Art)
FIG. 3 is a Moen® Posi-Temp valve body equipped with lip extensions.
Figure 6:
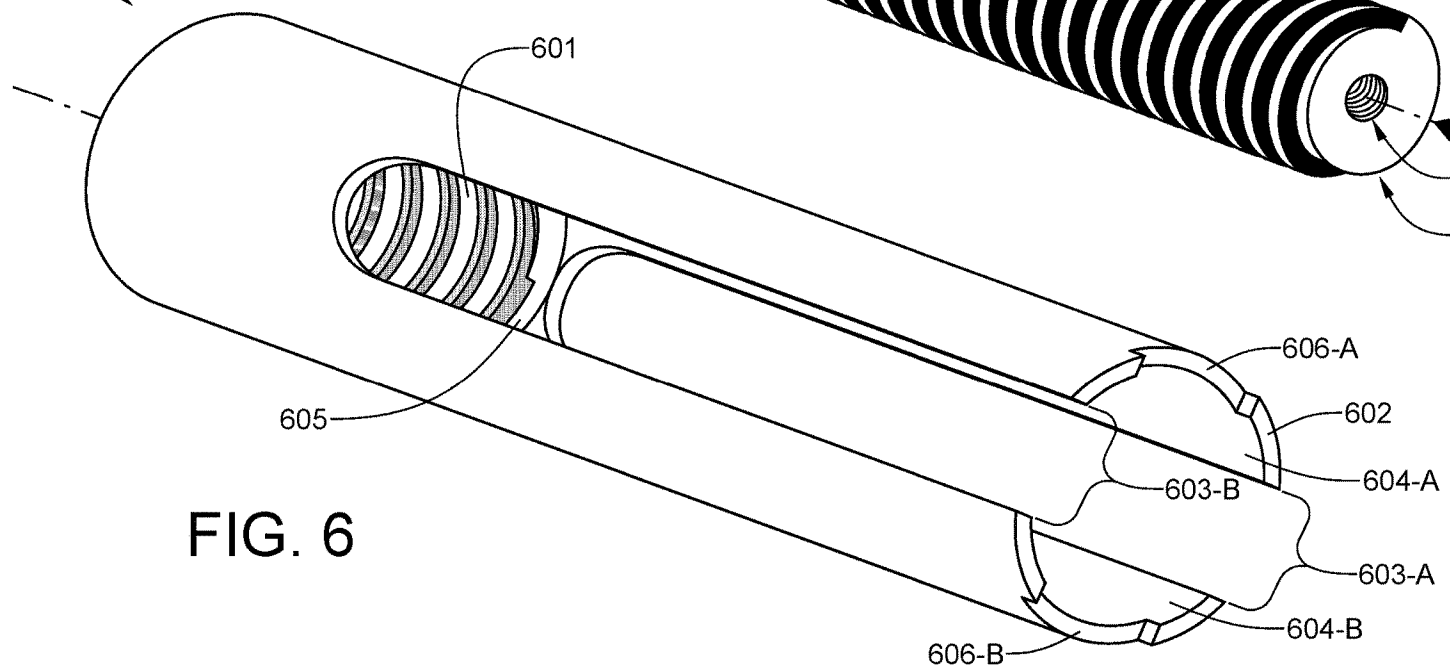

Referring now to FIG. 6, a tubular extractor body 600 has a left-hand female Acme thread 601 at the aft end thereof, which threadably engages the left-hand Acme male thread 404 of the extractor shaft 400. The fore end 602 of the tubular extractor body 600 buts up against the lip 202 at the mouth of Posi-Temp cartridge housing 203. The tubular extractor body 600 is equipped with a pair of opposed longitudinal slots 603-A and 603-B, which provide clearance for the upper and lower plastic ears 204-U and 204-L, respectively of the Posi-Temp® cartridge as the latter is extracted from the cartridge housing 203. It will be noted that a major anterior internal portion of the tubular extractor body 600 has a pair of opposed hemi-cylindrical walls 604-A and 604-B, which end at an annular barrier 605 located precisely where the left-hand female Acme thread 601 begins. Some, but not all models of the Moen® Posi-Temp valves have lip extensions at the opening of the cartridge installation socket. FIG. 3 shows a valve with lip extensions 301-A and 301-B. For this reason, the fore end of the tubular extractor body 600 has shallow cutouts 606-A and 606-B which fit over the lip extensions. For Posi-Temp valve bodies without the lip extensions, the cutouts serve no purpose. The presently preferred dimensions of the tubular extractor body 600 are as follows: the length is 4.0 inches; the outside diameter is 1.25 inch; the inside diameter is 1.1 inch; the inside diameter of the left-hand Acme female 601 thread is 0.650 inch; the length of each of the longitudinal slots 603-A and 603-B is 3.0 inches; the width of each longitudinal slot 603-A and 603-B is 0.506 inch; the length of the left-hand female Acme thread is 1.0 inch; the width of the half circle at the aft end of each longitudinal slot 603-A and 603-B is 0.175 inch; the width of the shallow cutouts 606-A and 606-B at the fore end of the tubular extractor body 600 is 0.615 inch; and the depth of each of the shallow cutouts 606-A and 606-B is 0.10 inch.

Figure 7:
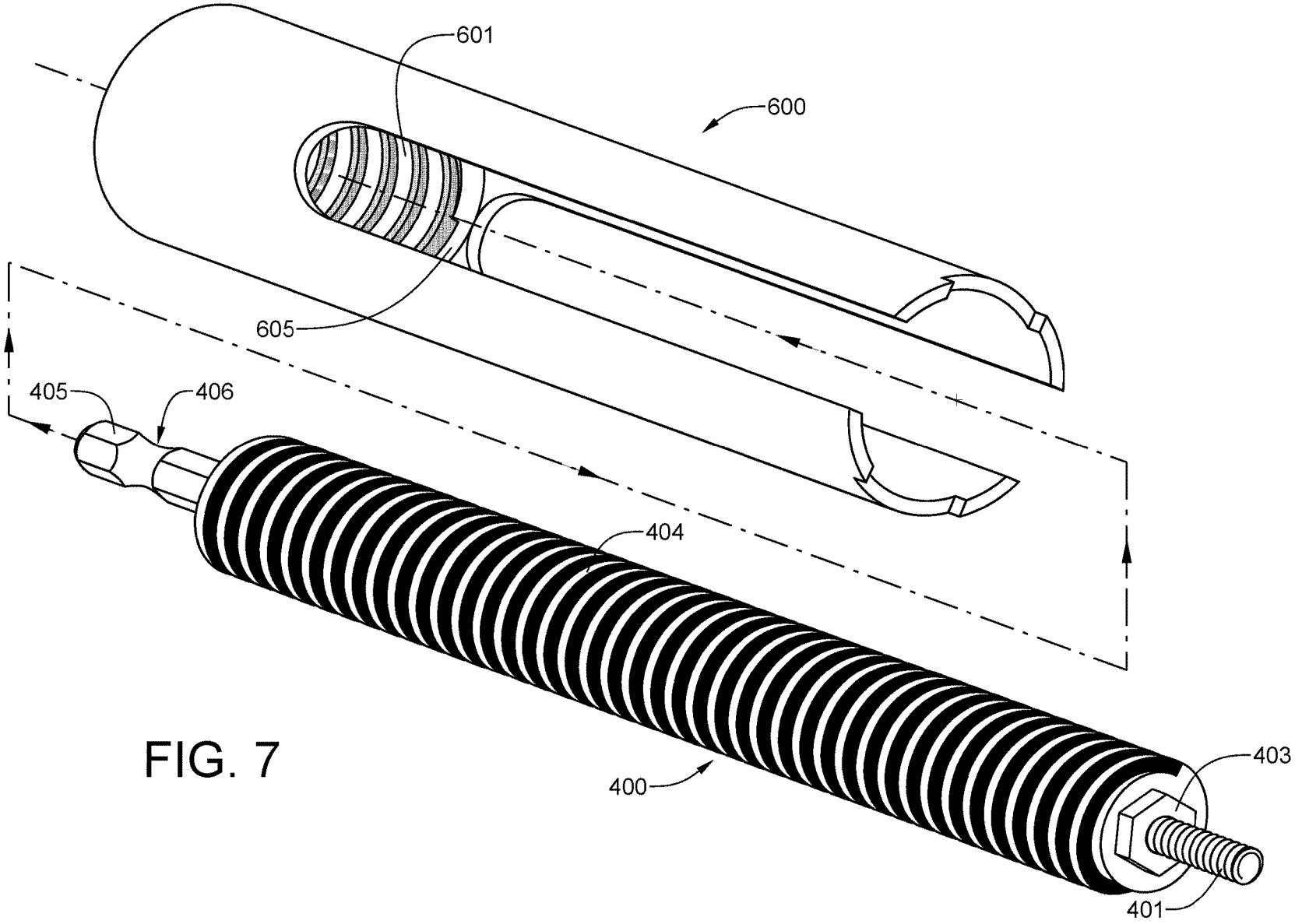
FIG. 7 is an isometric view of the tubular extractor body and the extractor shaft, showing how the extractor shaft axially and threadably installs within the tubular extractor body.

Referring now to FIG. 7, the extractor shaft 400 is shown together with the tubular extractor body 600. The drawing shows how the extractor shaft 400 is axially engages the tubular extractor body 600. Although the extractor shaft 400 can be installed into either end of the tubular extractor body 600, threaded insertion through the interior of the tubular extractory body 600 requires fewer rotations of the extractor shaft 400 to position it properly for the cartridge extraction process.

Figure 8:
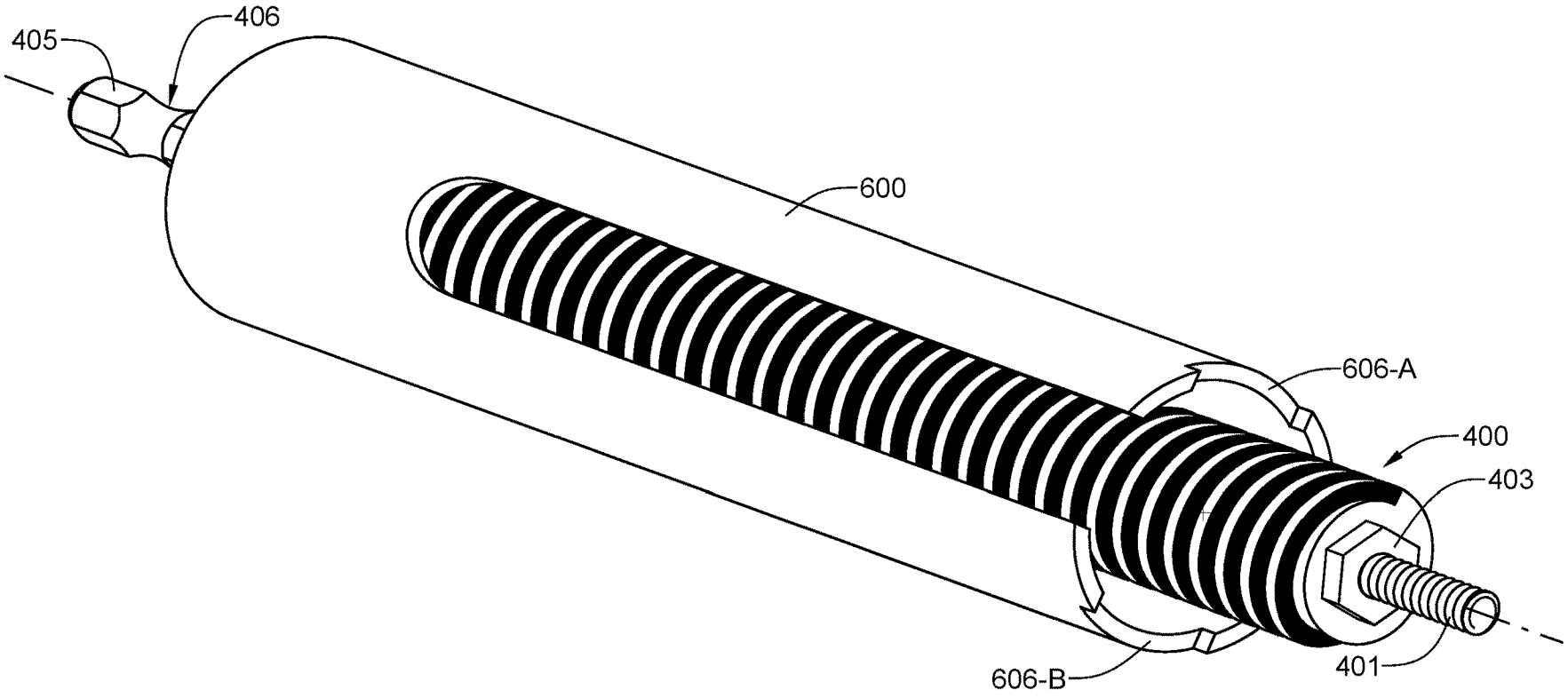
FIG. 8 is an isometric view of the extractor shaft threadably installed within the tubular extractor body.

Referring now to FIG. 8, the extractor shaft 400 has been threadably installed within the tubular extractor body 600 and is now ready to remove the cartridge of a Posi-Temp valve.

Figure 9:
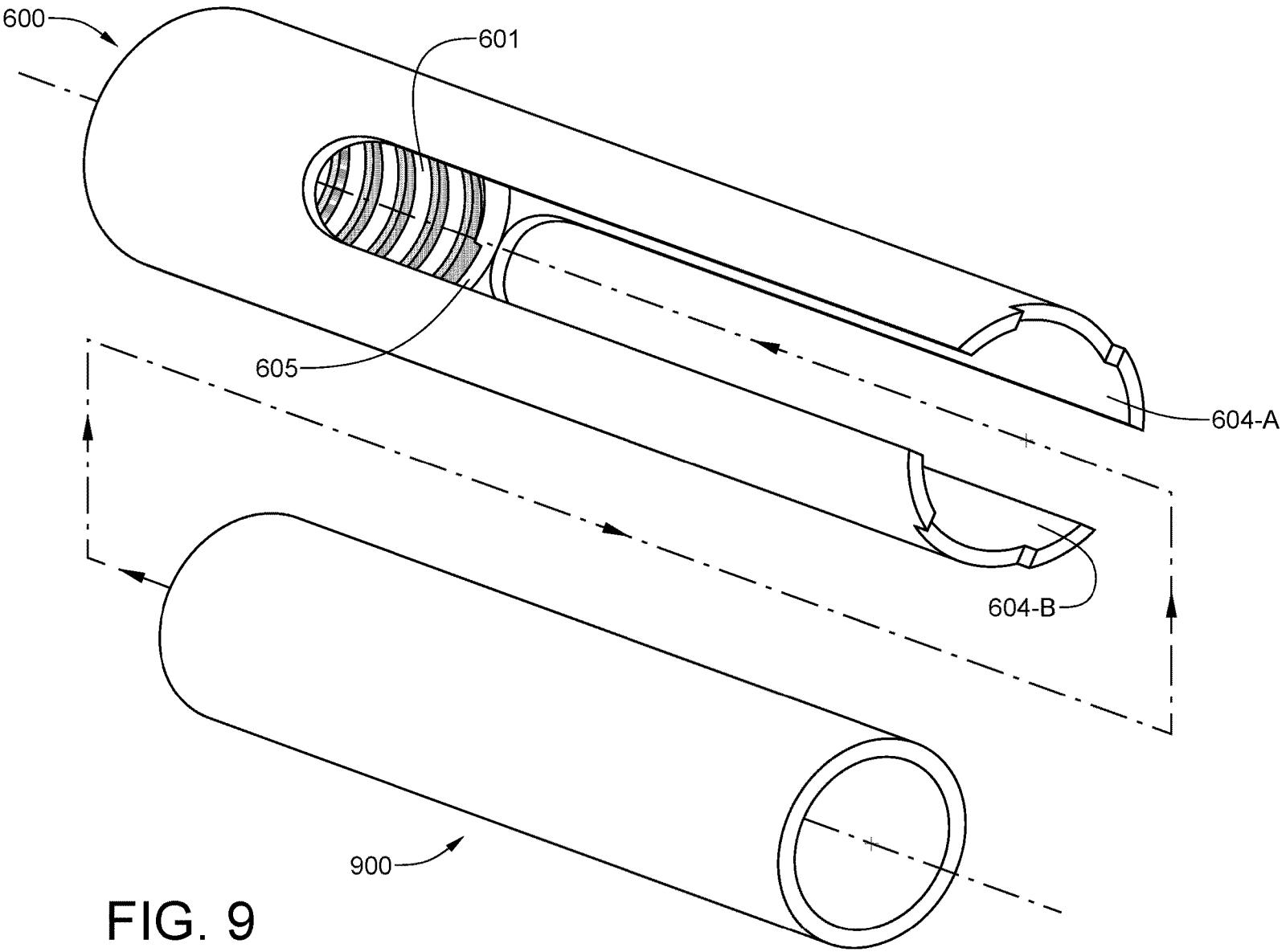
FIG. 9 is an isometric view of the tubular extractor body and the adapter sleeve, showing how the latter fits within a recess in the former.

Referring now to FIG. 9, an adapter sleeve 900 is shown that enables the cartridge extractor (consisting of the extractor shaft 400 and the tubular extractor body 600) to remove old style ¾-inch diameter cartridges, such as Moen® cartridge number 1225 old style Moen® valve bodies. The adapter sleeve 900 fits into the chamber between the two hemisperical walls 604-A and 604-B of the tubular extractor body and buts up against the annular barrier 605. Either end of the adapter sleeve 900 mates with the lip 104 of the old style valve body 100. As the old style 1225 valve cartridges 102 have no projecting ears, no opposed longitudinal slots, such as slots 603-A and 603-B in the tubular extractor body, need be machines in the sleeve. The presently preferred dimensions of the adapter sleeve 900 are as follows: 1.0 inch outside diameter; 0.755 inside diameter; and a length of 3.0 inches.

Figure 10:
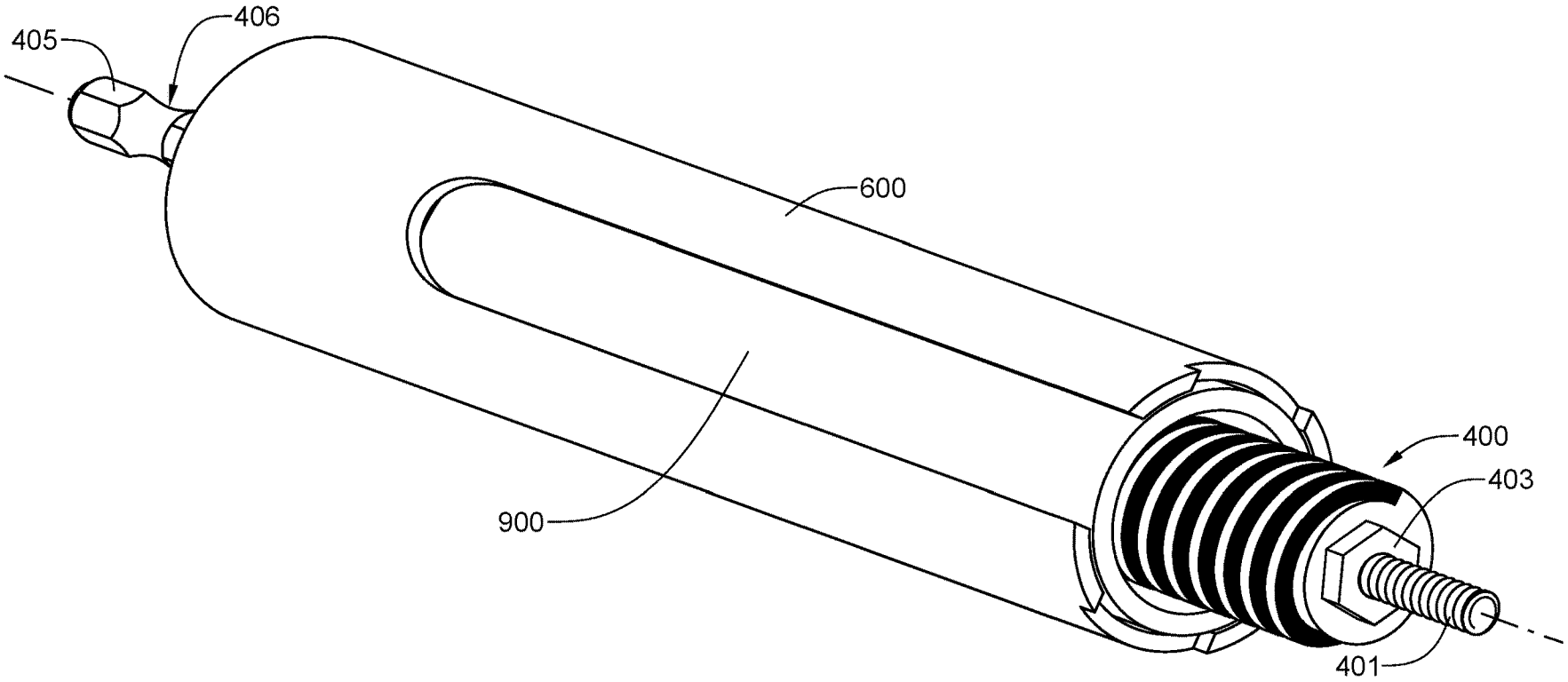
FIG. 10 is an isometric view of the extractor shaft threadably installed within the tubular extractor body and the adapter sleeve installed between the tubular extractor body and the extractor shaft.

Referring now to FIG. 10, the extractor shaft 400 has been threadably installed within the tubular extractor body 600, and the adapter sleeve 900 has been installed between the tubular extractor body 600 and the extractor shaft 400.

The cartridge extractor tool of the present invention is unique in that it incorporates both a right-hand male thread and a left-hand male thread on the same shaft. Because the extractor shaft is equipped with both a left-hand thread and a right-hand thread, any Moen® cartridge can be extracted from the valve body in a single step following removal of the retainer clip 103 or 209. With the exposed tip of the threaded coupler shank 401 about even with the fore end of the tubular extractor body 600, clockwise rotation of the extractor shaft 400 (seen from the rear of the extractor shaft 400), while holding and preventing the tubular extractor body 600 from rotating allows the threaded shank to coaxially engage the internally-threaded end of the control stem 106 or 207, while simultaneously pushing the tubular extractor body 600 toward the lip 104 or 202 at the open end of the cylindrical valve cartridge containment chamber 101 or 201, once the fore end of the tubular extractor body 600 abuts the lip 104 or 202, the cartridge 102 or 205 is extracted, all in a single step. Because the cartridge control stem 106 or 207 is free to rotate within the cartridge 102 or, it spins freely, driven by the extractor shaft 400, as the cartridge 102 or 205 is extracted from the valve cartridge containment chamber 101 or 201.

Although only a single embodiment of the improved cartridge extractor tool has been shown and described, it will be obvious to those having ordinary skill in the art that changes and modifications may be made thereto without departing from the scope and the spirit of the invention as hereinafter claimed.

What is claimed is:

1. A tool for extracting a valve cartridge having a single control stem from a valve body in which the cartridge is installed within an open-ended, cylindrical valve cartridge containment chamber and held in place with a retainer clip, said tool comprising:

an extractor shaft with an aperture at a fore end thereof that is internally threaded, said extractor shaft having a trapezoidal left-hand male thread, coaxial with the internally-threaded aperture, that extends a major portion of a length of the extractor shaft; and a drive shaft axially extending from an aft end of the extractor shaft, said drive shaft enabling coupling of the extractor shaft to a rotary power tool;

a tubular extractor body having a trapezoidal left-hand female thread at an aft end thereof that engages the trapezoidal left-hand male thread of the extractor shaft, said tubular extractor body having a fore end that buts up against a lip of the valve body that surrounds the open end of the valve cartridge containment chamber when extraction of the cartridge from the containment chamber begins;

a coupler shank, having a right-hand male thread, which is threadably installed within said internally-threaded aperture; and an adapter sleeve that fits within a recess between the extractor shaft and the tubular extractor body and enables the tool to extract cartridges having a nominal diameter of 0.75 inch, said adapter sleeve being removable in order to extract cartridges having a nominal diameter of 1.00 inch;

wherein, following removal of the retainer clip, clockwise rotation of the extractor shaft while holding and preventing the tubular extractor body from rotating allows the threaded coupler shank to coaxially engage an internally and axially threaded exposed end of the control stem, while simultaneously pushing the extractor body toward the valve body, and wherein once the fore end of the extractor body abuts the lip of the valve body, the cartridge is extracted, all in a single step.

2. The tool of claim 1, wherein said left-hand male thread and said left-hand female thread are both Acme threads.

3. The tool of claim 2, wherein said left-hand male Acme thread has a nominal outside diameter of 0.75 inch.

4. The tool of claim 1, wherein the coupler shank has a right-hand 10-24 thread.

5. The tool of claim 1, wherein said tubular extractor body incorporates a pair of opposed longitudinal slots, which provide clearance for upper and lower plastic ears on the cartridges that provide pressure-balancing function between hot and cold water inputs to a valve, as the cartridge enters the tubular extractor body during an extraction operation.

6. The tool of claim 1, which further comprises a pair of opposed recesses on a fore end of the tubular extractor body, said recesses fitting over projections on the lip that surrounds the open end of the valve cartridge containment chamber.

7. A tool for extracting a valve cartridge having a single control stem from an open-ended, cylindrical valve containment chamber in a valve body, said tool comprising:

an extractor shaft with an aperture at a fore end thereof that is internally threaded, said extractor shaft having a trapezoidal left-hand male thread, coaxial with the internally-threaded aperture, that extends a major portion of a length of the extractor shaft; and a drive shaft axially extending from an aft end of the extractor shaft, said drive shaft enabling coupling of the extractor shaft to a rotary power tool;

a tubular extractor body having a trapezoidal left-hand female thread at an aft end thereof that engages the trapezoidal left-hand male thread of the extractor shaft, said tubular extractor body having a fore end that buts up against a lip of the valve body that surrounds the open end of the valve cartridge containment chamber when extraction of the cartridge from the containment chamber begins, said tubular extractor body also incorporating a pair of opposed longitudinal slots, which provide clearance for upper and lower plastic ears on cartridges that provide pressure-balancing function between hot and cold water inputs to a valve, as the cartridge enters the tubular extractor body during an extraction operation;

a coupler shank, having a right-hand male thread, which is threadably installed within said internally-threaded aperture; and an adapter sleeve that fits within a recess between the extractor shaft and the tubular extractor body and enables the tool to extract cartridges having a nominal diameter of 0.75 inch, said adapter sleeve being removable in order to extract cartridges having a nominal diameter of 1.00 inch;

wherein, following removal of a retainer clip that retains the valve cartridge within the valve containment chamber, clockwise rotation of the extractor shaft, while holding and preventing the tubular extractor body from rotating, allows the threaded coupler shank to coaxially engage an internally and axially threaded exposed end of the control stem, while simultaneously pushing the tubular extractor body toward the lip of the valve containment chamber, and wherein once the fore end of the extractor body abuts the lip of the valve body, the cartridge is extracted, all in a single step.

8. The tool of claim 7, wherein said left-hand male thread and said left-hand female thread are both Acme threads.

9. The tool of claim 8, wherein said left-hand male Acme thread has a nominal outside diameter of 0.75 inch.

10. The tool of claim 7, wherein the coupler shank has a right-hand 10-24 thread.

11. The tool of claim 7, which further comprises a pair of opposed recesses on a fore end of the tubular extractor body, said recesses fitting over projections on the lip that surrounds the open end of the valve cartridge containment chamber.

12. A tool for extracting a single-control-stem valve cartridge having a nominal outer diameter of 1 inch from a valve body in which the cartridge is installed within an open-ended, cylindrical valve containment chamber, in which axial movement of the cartridge is prevented by a retainer clip, said tool comprising:

an extractor shaft with an aperture at a fore end thereof that is internally threaded, said extractor shaft having a trapezoidal left-hand male thread, coaxial with the internally-threaded aperture, that extends a major portion of a length of the extractor shaft; and a drive shaft axially extending from an aft end of the extractor shaft, said drive shaft enabling coupling of the extractor shaft to a rotary power tool;

a tubular extractor body having an outer nominal diameter of 1.25 inch, a trapezoidal left-hand female thread at an aft end thereof that engages the trapezoidal left-hand male thread of the extractor shaft, said tubular extractor body having a fore end that buts up against a lip that surrounds the opening of the valve cartridge containment chamber when extraction of the cartridge from the containment chamber begins, said tubular extractor body also incorporating a pair of opposed longitudinal slots, which provide clearance for upper and lower plastic ears on the cartridges that provide pressure-balancing function between hot and cold water inputs to a valve, as the cartridge enters the tubular extractor body during an extraction operation;

an adapter sleeve that fits within a recess between the extractor shaft and the tubular extractor body, is supported at an aft end by an annular barrier located where the left-hand female Acme thread begins, and enables the tool to extract cartridges having a nominal outside diameter of 0.75 inch;

a coupler shank, having a right-hand male thread, which is installed within said internally-threaded aperture; and a nut which is threadably installed on said coupler shank and tightened against the fore end of said extractor shaft;

wherein, following removal of the retainer clip that retains the valve cartridge within the valve containment chamber, clockwise rotation of the extractor shaft, while holding and preventing the tubular extractor body from rotating, allows the threaded coupler shank to coaxially engage the internally-threaded exposed end of the control stem, while simultaneously pushing the tubular extractor body toward the lip of the valve containment chamber, and once the extractor body abuts the lip, the cartridge is extracted, all in a single step.

13. The tool of claim 12, wherein said left-hand male thread and said left-hand female thread are both Acme threads.

14. The tool of claim 12, wherein the coupler shank has a right-hand 10-24 thread.

15. The tool of claim 12, which further comprises a pair of opposed recesses on a fore end of the tubular extractor body, said recesses fitting over projections on the lip of the valve body.

16. The tool of claim 1, which further comprises a nut which is threadably installed on said coupler shank and tightened against the fore end of said extractor shaft.

17. The tool of claim 7, which further comprises a nut which is threadably installed on said coupler shank and tightened against the fore end of said extractor shaft.

* * * * *